United States Patent [19]

Zerega

[11] Patent Number: 4,829,877

[45] Date of Patent: May 16, 1989

[54] BLANK FIRING FIREARM RECOIL MECHANISM

[76] Inventor: James E. Zerega, 16905 Olde Mill Run, Rockville, Md. 20855

[21] Appl. No.: 165,149

[22] Filed: Mar. 7, 1988

[51] Int. Cl.[4] ..... F41C 21/18; F41F 27/00

[52] U.S. Cl. ..... 89/14.5; 89/193; 434/18

[58] Field of Search ..... 42/54, 55, 57, 58, 106; 89/14.5, 193; 272/14, 20; 434/18

[56] References Cited

U.S. PATENT DOCUMENTS

| | | | |
|---|---|---|---|
| 1,003,632 | 9/1911 | McClean | 89/193 |
| 2,023,497 | 12/1935 | Trammell | 434/18 |
| 2,144,241 | 1/1939 | Eiane | 89/193 |
| 2,679,192 | 5/1954 | Seeley et al. | 89/193 |
| 2,708,319 | 5/1955 | Tratsch | 434/18 |
| 3,354,571 | 11/1967 | Parker | 42/106 |
| 4,088,057 | 5/1978 | Nasypany | 89/193 |
| 4,380,437 | 4/1983 | Yarborough | 434/18 |
| 4,414,880 | 11/1983 | Throner | 89/193 |
| 4,503,632 | 3/1985 | Cuevas | 42/1.06 |

FOREIGN PATENT DOCUMENTS

| | | | |
|---|---|---|---|
| 679591 | 8/1939 | Fed. Rep. of Germany | 89/14.5 |
| 687392 | 1/1940 | Fed. Rep. of Germany | 89/14.5 |
| 714566 | 12/1941 | Fed. Rep. of Germany | 89/193 |
| 1195205 | 6/1965 | Fed. Rep. of Germany | 89/14.5 |

*Primary Examiner*—Stephen C. Bentley
*Attorney, Agent, or Firm*—Robert E. Bushnell

[57] ABSTRACT

An accessory for converting a small bore firearm into a safe theatrical stage prop providing both aural effects of the "report" of detonated gunpowder and visual effects of discharged "gunsmoke" and "recoil" motion imparted to the body of a user, is constructed with a central passage 20 partially obstructed by a dimensionally conforming cylindrical mass 36. Effluent in the form of expanding gases of detonated gunpowder enter central passage 20 via proximal orifice 16, impart forward motion in a preferred direction to cylindrical mass 36 and, as movement of mass 36 exposes connecting passages 30, the effluent bypasses the central portion of passage 20 via passages 22 and exits the barrel 10 of the accessory via distal orifice 18. Motion imparted to mass 36 first by the expanding effluent and then in a reverse direction by compressed spring 40, simulates the visual effect of "recoil" upon detonation of a blank cartridge of ammunition.

20 Claims, 1 Drawing Sheet

BLANK FIRING FIREARM RECOIL MECHANISM

TECHNICAL FIELD

The present invention pertains to theatrical simulating props and, more particularly, to barrels for blank firing firearms.

BACKGROUND ART

Occasionally, the script of a theatrical production requires the use of a firearm on-stage during the course of a performance. It is of course, always desirable for actors to simulate the characteristics, nuances and mannerisms of real-life behavior during the performance. Concomitantly however it is paramount that actors endeavor to preserve human safety, both for their own benefit and for that of their audience, while realistically duplicating human movements and mannerisms.

In scenes where the script requires the discharge of firearms, the paramount requirements for human safety have typically indicated use of blank cartridges (i.e., cartridges containing only a propellant powder and no projectile) such as, for example, a "starter's pistol." Such techniques endow a scene with realism through both the visual exhibition of the firearm and the aural report of the blank cartridge upon its detonation. Firearms loaded with live ammunition however, are well known for their characteristic recoil phenomena which, in accordance with Newton's third law of motion, imparts some degree of motion to the wrist, arm and shoulder of its user. Although recoil mechanisms have been employed in various configurations with firearms, those mechanisms have universally been constructed to absorb recoil and thereby, minimize the attendant motion imparted to a user's wrist, arm and shoulder by a detonation.

STATEMENT OF THE INVENTION

Accordingly, it is an object of the current invention to provide an improved theatrical prop.

It is another object to provide a theatrical prop capable of imparting motion to the limb of its user upon detonation of blank cartridge ammunition.

It is still another object to provide a theatrical prop simulating the visual and aural characteristics of a firearm while imparting motion to the limb of its user upon detonation of blank cartridge ammunition.

It is yet another object to provide a firearm suitable for theatrical uses which exhibits a recoil effect upon detonation of blank cartridge ammunition.

These and other objects are achieved in a accessory for a small bore firearm which serves as a recoil mechanism to impart a modicum of motion to the user upon detonation of blank cartridge ammunition. The accessory includes an elongated element providing a plurality of passages extending through a central section of the element with a central one of the passages extending along an axis through opposite ends of the element. The plurality of passages other than the central passage are connected to the central passage, and receive and conduct effluent emanating from discharge of a propellant, such as gunpowder in a blank cartridge, in a chamber of a small bore firearm adjoining an orifice at one end of the elongated element, in a preferred direction along the longitudinal axis of the elongated element between orifices in the opposite ends of the element independently of the central section of the central one of the passages. A mass with external dimensions transverse to the axis which substantially conforms to the internal transverse dimensions of the central passage, is disposed within a central section of the central passage. Additional elements, such as posts affixed to the elongate element, confine travel of the mass within the central passage to the central section. A biasing element urges the mass toward the end section of the central passage receiving the effluent while accommodating travel of the mass in the preferred direction along the central passage under pressure of the effluent.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
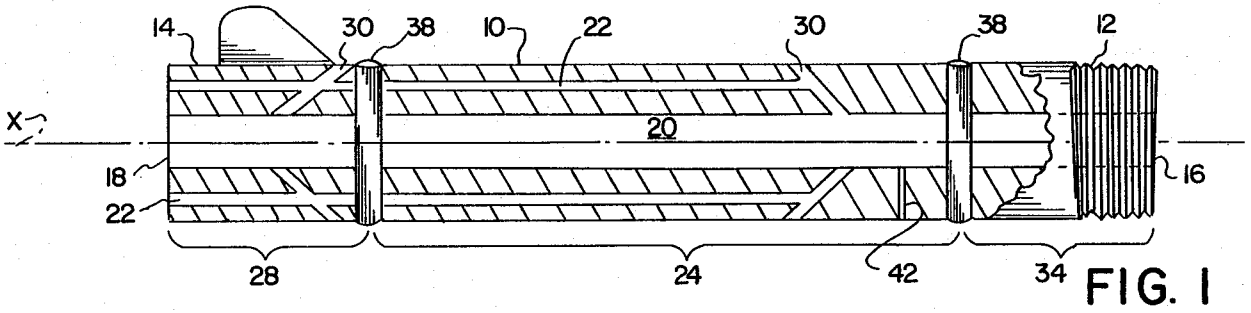
FIG. 1 is a partially cut-away front view showing one embodiment made according to the principles of the present invention.

FIG. 1 shows a barrel 10 having a proximal end 12 bearing male threads around the terminal portion of its circumferential surface. These threads enable proximal end 12 to be received in and retained by a chamber (not shown) of a commercially available firearm such as, for example, a revolver or a "starter's pistol" of corresponding caliber suitable for firing blank cartridge ammunition.

Figure 2:
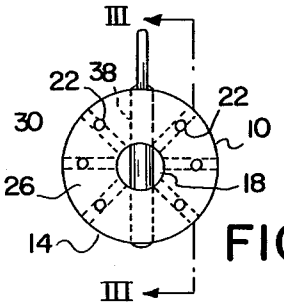
FIG. 2 is a side view of the distal end of the embodiment shown in FIG. 1.

Both proximal end 12 and its axially opposite distal end 14 are perforated by orifices 16, 18, respectively of a centrally disposed passage 20 which extends throughout the entire length of barrel 10, along its longitudinal axis X. As may also be seen from FIG. 2, six circumferentially spaced-apart passages 22 are disposed radially outwardly from central passage 20 from a central portion 24 of barrel 10, opening at the transverse face 26 of distal end 14. For ease of machining, passages 22 are bored in parallel alignment, parallel to central axis X, through transverse face 26, through distal section 28 and most of the length of central section 24 of barrel 10. Then, connecting passages 30 are obliquely bored through the outer circumferential surfaces of central section 24 and distal section 28, to individually connect each of passages 22 to central passage 20 within both central section 24 and distal section 28.

Turning now to FIG. 3, and again for purposes of facilitating manufacture, the openings of passages 22 formed in transverse face 26, and the openings formed by connecting passages 30 on the circumferential exterior surface of central section 24 and distal section 28 of barrel 10 are closed by, for example, threaded plugs 32, or alternatively, by solid metal inserts (not shown). When plugs 32 are in place, passages 22 and their respective connecting passages 30 provide a plurality of bypass conduits extending from the portion of chamber 20 within central section 24 nearest proximal section 34, to the interior of central passage 20 within distal section 28. These conduits permit an effluent such as the explosive gases which emanate from gunpowder upon detonation, to be introduced into central passage 20 via proximal end orifice 16, and to continue along central passage 20 and into central section 24, then travel via connecting passages 30 through bypass passages 22 and connecting passages 30, to the portion of central passage 20 within distal section 28, and ultimately exit barrel 10 via distal end orifice 18. Consequently, effluent introduced into central passage 20 via proximal end orifice 16 will travel in a preferred direction along a length of barrel 10 and ultimately exit barrel 10 via distal orifice 18.

To assure that effluent entering central passage 20 via proximal end orifice 16 will travel in the preferred direction through connecting passages 30 and bypass passages 22, rather than through the central portion of passage 20 within central section 24, and to simultaneously impart motion in the preferred direction and thereby affect a recoil effect to a firearm, and thus the hand, wrist and arm of a user, a mass 36 is placed in central passage 20, within central section 24. In the embodiment shown, central passage 20 has substantially uniform radial dimensions extending along its entire length. In the same embodiment, mass 36 is formed as a cylindrical, preferably solid slug of a material such as metal, having radial dimensions substantially conforming to those of central passage 20, particularly that portion of central passage 20 within central section 24. Conformance of the radial dimensions of mass 36 with the radial dimensions of the central portion of central passage 20 will hinder passage of effluent gases of detonated gunpowder from traveling through central passage 20 within central section 24, and force the effluent gases to first impart motion to mass 36 in the preferred direction until connecting passages 30 and bypass passages 22 have been uncovered by movement of mass 36.

Figure 3:
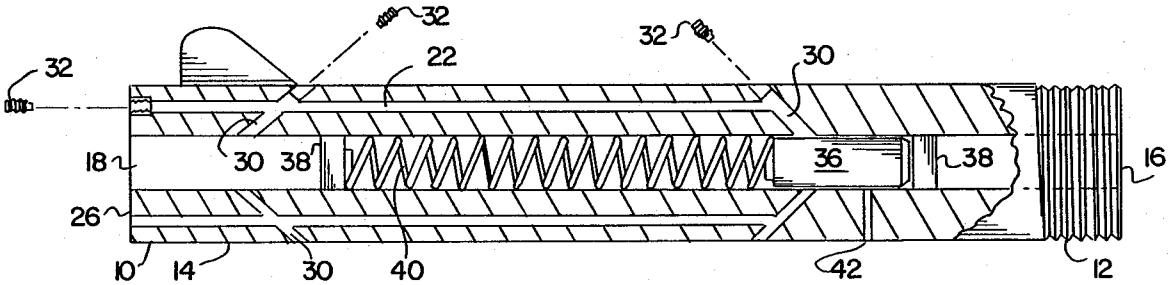
FIG. 3 is a front, partially cut-away sectional view taken along lines III—III' in FIG. 2.

The travel of mass 36 may be restricted to a central portion of central passage within central section 24 by a pair of posts 38 (shown in greater detail in FIG. 1) disposed diametrically across barrel 10 and central passage 20 at the junctions between proximal section 34 and central section 24 and between central section 24 and distal section 28. A bias element such as a compression spring 40 disposed for example, with its distal end either abutting or connected to post 38 at the junction between central section 24 and distal section 28 and its proximal end engaging the leading base of cylindrical mass 36, assures disposition of mass 36 at the junction between distal section 34 and central section 24, while mass 36 is in its rest position. Consequently, when compression spring 40 maintains mass 36 at its rest position, mass 36 blocks connecting passages 30. Then, when the expanding gases of detonated gunpowder enter passage 20 via proximal orifice 16 as effluent, the concomitant force of expansion of the effluent will force mass 36 to travel in the preferred direction from its rest position as shown in FIG. 3, against the force of expanded compression spring 40 and toward orifice 18, thereby uncovering both a small vent 42 and connecting passages 30 leading to bypass passages 22. This allows the expanding gases of the effluent to bypass the central portion of passage 20 within central section 24 via bypass passages 22 and connecting passages 30 and thereby exit distal end orifice 18 to provide the visual characteristics of "gunsmoke" exiting the distal end of a firearm's barrel while concomitantly forcing mass 36 to travel in the same preferred direction along the central section and thereby compress spring 40; subsequently, as the pressure of the expanding gases is attenuated via connecting passages 30 and bypass passages 22, and vent 42, the now compressed spring 40 will force mass 36 to undergo travel in an opposite direction as it is forced to return to its rest position.

Vent 42 optionally enables gases escaping from central passage 20 to be used for operation of an automatic reloading device (for example, on an M-1 rifle). Vent 42 therefore permits barrel 10 to be incorporated into the particular firearm (e.g., a "revolver," a "bolt action" or an "automatic") being emulated; accordingly, in some applications, vent 42 may be closed, as with a plug 32.

It is apparent from the foregoing that the current invention provides an improved accessory for modifying a small bore firearm such as a rifle, shotgun or pistol, for use as a theatrical prop. In the embodiment disclosed, as well as in the several possible modifications thereof, consideration should be given to conformity between the radial dimensions of central passage 20 and cylindrical mass 36, the "mass" (i.e., "weight") of cylindrical mass 36, the aggregate cross-sectional area of vent 42, connecting passages 30 and bypass passages 22, and the length and spring constant of compression spring 40 to assure that both the correct magnitude and near coincidence in timing occurs between detonation of a round of blank cartridge ammunition and the resulting aural effect of the "report" of detonated gunpowder, visual effect of "gunsmoke" escaping via distal end orifice 18 and the visual effect of "recoil" resulting from movement of mass 36 under first the pressure of expanding effluent and then under the force of compressed spring 40.

It is evident that those skilled in the art may now make numerous uses and modifications of the specific embodiments described herein without departing from the inventive concepts disclosed. Consequently, the invention is to be construed as embracing each and every novel feature and combination of features present in or possessed by the apparatus and techniques herein disclosed, and is limited solely by the spirit and scope of the appended claims.

I claim:

1. A recoil mechanism for a small bore firearm, comprising:

elongate means having first and second end sections disposed at axially opposite ends of a central section, said first and second end sections providing axially opposed orifices, said elongate means providing a plurality of passages extending through said central section with a central one of said passages extending along an axis through said first end, said second end and said central section, said plurality of passages being connected to said central one of said passages, for receiving and for conducting and discharging via one of said axially opposed orifices provided by said second end section effluent emanating from discharge of a propellant adjacent to one of said axially opposed orifices in said first end section, in a discharging direction along said axis between said axially opposed orifices in said first and second end sections independently of the central one of said passages along said central section;

a mass disposed within said central one of said passages along said central section, having external dimensions transverse to said axis substantially conforming to internal dimensions transverse to said axis of said central one of said passages within said central section;

means affixed to said elongate means, for confining travel of said mass within the central one of said passages to said central section; and means for biasing said mass toward said first one of said end sections while accommodating travel of said mass in said discharging direction along the central one of said passages while under pressure of said effluent.

2. The mechanism of claim 1, wherein said plurality of passages includes said central one of said passages and a plurality of conduits substantially parallel to and disposed radially outwardly from said central passage.

3. The mechanism of claim 1, wherein each of said plurality of passages includes a shaft opening to an exterior surface of said elongate means.

4. The mechanism of claim 2, wherein each of said plurality of conduits includes a shaft opening to an exterior surface of said elongate means.

5. The mechanism of claim 4, further comprised of means disposed at the exterior surfaces of said elongate means, for blocking passage of said effluent through the exterior surfaces of said elongate means.

6. A recoil mechanism for a small bore firearm, comprising:

elongate means having first and second end sections disposed at axially opposite ends of a central section, said central section having a first portion joining said first end section, a second portion joining said second end section, and an intermediate portion disposed in alignment with said first and second portions, said first and second end sections providing axially opposed orifices, said elongate means providing a plurality of passages extending through said central section with a central one of said passages extending along an axis through said first end, said second end and said central section, said central one of said passages defining a continuous channel between said first and second portions with uniform dimensions extending transversely to said axis along the length of said central section, the ones of said passages other than said central one of said plurality of passages being connected to said central one of said passages within said first portion of said central section and extending through said intermediate portion and being connected to said central one of said passages, within said second end section, for receiving, for conducting and for discharging via a first one of said axially opposed orifices in said second end section effluent emanating from discharge of a propellant adjacent to a second one of said axially opposed orifices in said first end section, in a discharging direction along said axis between said axially opposed orifices in said first and second end sections and through the other ones of said passages independently of the intermediate and second portions of said central one of said passages along said central section;

a mass disposed within said central one of said passages along said central section, having external dimensions transverse to said axis substantially conforming to internal dimensions transverse to said axis of said channel within said central section;

means affixed to said elongate means, for confining travel of said mass within the central one of said passages to said central section; and means for biasing said mass to a rest position within said first portion and toward said first one of said end sections whereby said mass obstructs passage of effluent from said first section through said first portion and said other ones of the passages while said mass is in the rest position, and for accommodating travel of said mass through the channel in said discharging direction along the intermediate portion of said central one of said passages while under pressure of said effluent.

7. The mechanism of claim 6, wherein said other ones of the passages includes a plurality of conduits substantially parallel to and disposed radially outwardly from said central one of said passages.

8. The mechanism of claim 6, wherein each of said other ones of said plurality of passages includes a shaft opening to an exterior surface of said elongate means.

9. The mechanism of claim 7, wherein each of said plurality of conduits includes a shaft opening to an exterior surface of said elongate means.

10. The mechanism of claim 9, further comprised of means disposed at the exterior surfaces of said elongated means, for blocking passage of said effluent through the exterior surfaces of said elongate means.

11. The mechanism of claim 1, wherein during the absence of travel of said mass in said discharging direction while under pressure of effluent, said biasing means biases said mass toward said first end section and a rest position within a first portion of said central one of said passages adjacent to said first end section, said mechanism being further comprised of a vent blocked by said mass when said mass is in the rest position, perforating said central section and extending from said central one of said passages to the exterior surface of said elongate means.

12. The mechanism of claim 5, wherein during the absence of travel of said mass in said discharging direction while under pressure of effluent, said biasing means biases said mass toward said first end section and a rest position within a first portion of said central one of said passages adjacent to said first end section, said mechanism being further comprised of a vent blocked by said mass when said mass is in the rest position, perforating said central section and extending from said central one of said passages to the exterior surface of said elongate means.

13. A recoil mechanism, comprising:

elongate means having first and second end sections coaxially disposed on axially opposite sides of an intermediate section, said first and second end sections providing axially opposed orifices, said elongate means providing a plurality of passages extending through said intermediate section, said plurality of passages being connected within a central one of said passages extending along an axis through said first end, said second end and said intermediate sections, for receiving and discharging via a first one of said axially opposed orifices in said second end section effluent at a second one of said axially opposed orifices provided by said first end section, for conducting effluent in a discharging direction along said axis between said axially opposed orifices in said first and second end sections independently of the central one of said passages along said intermediate section and for discharging effluent at said first one of said axially opposed orifices;

a mass disposed within said central one of said passages along said intermediate section, said mass having external dimensions transverse to said axis substantially conforming to internal dimensions transverse to said axis of said central one of said passages within said intermediate section having a rest position toward one of said end positions, and obstructing passage of effluent through said central one of said passages;

means affixed to said elongate means, for confining travel of said mass within the central one of said passages to said intermediate section; and means for biasing said mass toward said rest position adjacent to one of said end portions while accommodating travel of said mass in said discharging direction along the central one of said passages while under influence of said effluent.

14. The mechanism of claim 13, wherein said plurality of passages includes said central one of said passages and a plurality of conduits substantially parallel to and radially disposed outwardly from said central one of said passages.

15. The mechanism of claim 13, wherein each of said plurality of passages includes a shaft opening to an exterior surface of said elongate means.

16. The mechanism of claim 14, wherein each of said plurality of conduits includes a shaft opening to an exterior surface of said elongate means.

17. The mechanism of claim 16, further comprised of means disposed at the exterior surfaces of said elongate means, for blocking passage of said effluent through the exterior surfaces of said elongate means.

18. The mechanism of claim 13, wherein said plurality of passages are connected at junctions with said central one of said passages within said intermediate section, and said mass obstructs passage of effluent through said junctions while said mass is in the rest position.

19. The mechanism of claim 14, wherein said plurality of conduits are connected at junctions with said central one of said passages within said intermediate section, and said mass obstructs passage of effluent through said junctions while said mass is in the rest position.

20. The mechanism of claim 15, wherein said plurality of passages includes said central one of said passages and a plurality of conduits substantially parallel to said central one of said passages, said plurality of conduits being connected at junctions with said central one of said passages within said intermediate section, whereby said mass obstructs passage of effluent through said junctions while said mass is in the rest position.

* * * * *